US007343696B2

(12) United States Patent
Covert

(10) Patent No.: US 7,343,696 B2
(45) Date of Patent: Mar. 18, 2008

(54) DEVICE FOR LOADING AND UNLOADING CONTAINERS

(75) Inventor: William John Covert, Doylestown, PA (US)

(73) Assignee: IMA-Telstar S.L., Terrassa (ES)

( * ) Notice: Subject to any disclaimer, the term of this patent is extended or adjusted under 35 U.S.C. 154(b) by 90 days.

(21) Appl. No.: 11/159,000

(22) Filed: Jun. 22, 2005

(65) Prior Publication Data

US 2006/0016094 A1 Jan. 26, 2006

(30) Foreign Application Priority Data

Jul. 22, 2004 (EP) ..... 04380160

(51) Int. Cl.
*F26B 13/30* (2006.01)

(52) U.S. Cl. ..... 34/92

(58) Field of Classification Search ..... 34/217, 34/236, 92; 414/18; 198/346.2
See application file for complete search history.

(56) References Cited

U.S. PATENT DOCUMENTS

| | | | | |
|---|---|---|---|---|
| 3,469,327 | A * | 9/1969 | Catelli | 34/92 |
| 5,129,162 | A | 7/1992 | Hemmersbach et al. | 34/5 |
| 5,477,663 | A * | 12/1995 | Smith et al. | 53/475 |
| 5,551,821 | A | 9/1996 | Hall | 414/18 |
| 6,494,005 | B2 * | 12/2002 | Zimmerman | 52/296 |

FOREIGN PATENT DOCUMENTS

| | | |
|---|---|---|
| DE | 20102879 | 10/2001 |
| DE | 10307571 | 9/2004 |
| DE | 20313941 | 1/2005 |
| EP | 0618417 | 3/1994 |
| ES | 2130818 | 7/1999 |
| FR | 2643346 | 2/1989 |
| WO | 9635090 | 7/1996 |

OTHER PUBLICATIONS

Patent Abstracts of Japan. JP 63235214. Sep. 30, 1988 abstract.

* cited by examiner

*Primary Examiner*—S. Gravini
(74) *Attorney, Agent, or Firm*—Finnegan, Henderson, Farabow, Garrett, Dunner, L.L.P.

(57) ABSTRACT

A device (1) for loading and unloading containers (2) into and out of an enclosure of an installation (3) for treating substances contained in containers (2). The device includes a support structure (17) and a third means (16, 19, 21) for moving a second means (14) to a position higher than the containers. The second means (14) acts as a stop during loading and as a pusher during unloading. The device includes an extendible platform (10), wherein the extendible platform unfurls from the support structure (17) and the third means comprise parts (16*a* 16*b*) that unwind from the support structure (17) to the interior of the enclosure. The device is completely automatic, fast, takes up little space and is easy to disassemble.

13 Claims, 11 Drawing Sheets

1
2
3
4
5
6
7
8
9
10
11
12
13
14
15
16
17

DEVICE FOR LOADING AND UNLOADING CONTAINERS

This invention relates to a device for loading and unloading containers into and from an enclosure of an installation for treating substances contained in such containers.

BACKGROUND OF THE INVENTION

Known in the art are devices for loading and unloading containers at plants for treating substances, such as plants for drying products, called freeze-dryers.

Freeze-dryers are used for drying products, typically pharmaceutical or food products. Pharmaceutical products are placed in the freeze-dryer in glass containers, on flat shelves situated one above another to form the equivalent of shelving. Most freeze-dryers have means for moving said flat shelves vertically, so that they can either be stacked or placed one by one at a particular loading height.

The freeze-drying process, particularly for pharmaceutical products, requires maximum sterility of the product and its container but also of its manipulating elements, such as loading and unloading systems and treatment installations. For this reason, the parts of such installations that are in contact with the product and its container are normally placed in clean rooms, whose space is usually very small for reasons mainly associated with the high maintenance cost of such rooms. Before loading the freeze-dryer it is also normal to have all the manipulating elements undergo a cleaning and sterilisation process.

The design of loading and unloading devices for treatment plants such as freeze-dryers must take into account the space restriction of clean rooms and the need to have simple equipment that can be disassembled easily to clean and sterilise its parts. Moreover, again due to the need to ensure product hygiene, it should be taken into account that such devices must avoid to the utmost extent loading and unloading parts that remain inside the freeze-dryer during the treatment, as access into the freeze-dryer is difficult and means that such parts cannot be cleaned adequately.

U.S. Pat. No. 5,129,162 discloses a method and apparatus for loading and unloading freeze-drying apparatus including at least one placement surface adapted to receive containers. The containers are placed on a table top of a transfer table, and the transfer table is brought into proximity with the placement surface in a chamber of a freeze-drying apparatus. A retractable frame assembly, movably secured to the transfer table, is used to transfer the containers from the transfer table top to the placement surfaces.

The device of the cited US patent has the disadvantage that it occupies a large space in clean rooms since it comprises a formatting table and a transfer table that has to be brought into proximity with the freeze-drying apparatus once loaded with containers. Furthermore, the working speed is extremely slowly because during the loading and unloading process a large number of steps must be taken.

Patent ES 2130818 discloses a device for loading and unloading treatment equipment, such as freeze-dryers, which makes automatic loading and unloading of containers possible by means of a set of two encapsulated hydraulic cylinders, each of which has at its end a bar mounted transversally to the direction of travel of the cylinders. One of these cylinders is mounted at the rear part of the freeze-dryer and traverses the wall of the freeze-drying chamber by means of a sealed mechanical feedthrough, in such a way that the bar attached to its end moves over the freeze-dryer shelves from the rear part of the shelves. The other cylinder is mounted at the front part of the freeze-dryer, beside a conveyor belt which feeds the containers. The rear and front cylinder bars form an enclosure into which the rows of containers from the conveying device are loaded one by one, during the loading process, or from the freeze-dryer shelf during the unloading process.

In the loading process, for each row of containers loaded the two cylinders and bars move over the loading zone by a distance equivalent to the diameter of a container, and next, only the cylinder and front bar move back to the departure position to permit the entry of a new row of containers. This operation is repeated as many times as there are rows of containers that fit on a shelf of the freeze-dryer, until the loading zone is full. The loaded containers are then placed in the freeze-dryer by the joint action of both cylinders and bars, which move them aligned on said loading zone until they are situated on the shelf of the freeze-dryer.

In the unloading process, the two cylinders and bars move over the shelf of the freeze-dryer until all the containers have been placed aligned in the unloading zone, from which they are pushed by the rear cylinder and bar towards the conveyor belt which unloads them.

The device described in patent ES 2130818 has several disadvantages, as outlined below.

The sealed mechanical feedthrough for the rear cylinder which traverses the freeze-dryer chamber increases the risk of leaks in the chamber and, therefore, also increases the danger of lack of product and process sterility.

Furthermore, the presence of this part in the rear part of the freeze-drying chamber makes it impossible to mount the device on an existing freeze-dryer, since the space inside a freeze-dryer is very small and does not permit the mounting of new parts for which provision has not been made in advance. The mechanical modifications which this addition would entail for the freeze-dryer chamber would also be too costly.

The working cycle of the device of the above-mentioned patent has the disadvantage of having a time lag upon completion of loading of each shelf, as the rear cylinder and bar have to retract to their initial positions in order to allow the vertical movement of the loaded shelf and to await the positioning of a new shelf for loading containers. This time lag between the loading of shelves can be lengthy, and this has a negative effect on the efficiency of the device.

Utility model DE 20102879U1 describes a device for loading and unloading containers in treatment installations which resolves the disadvantages mentioned above.

Said device includes two moving parts to make automatic loading and unloading of containers possible. On the one hand, there is a cylinder and bar which during the loading process move the containers from the conveyor belt to a fixed platform, and on the other hand a flexible sheet which unfurls from a cylindrical drum. Both moving parts are external to the treatment installation and place themselves outside the installation during the treatment process, so they have the advantage that they do not hinder cleaning and sterilisation of the freeze-dryer.

In the loading process, for each row of containers loaded the cylinder and bar move over the fixed platform by a distance equivalent to the diameter of a container, and next, move back to the starting position in order to allow the entry of a new row of containers. The flexible sheet unfurls and advances intermittently by a distance equal to the diameter of a container each time it receives a row of containers from the fixed platform, so that when it reaches the flat shelf of the treatment installation it advances over its surface. This operation is repeated as many times as there are rows of containers that fit on a flat shelf of the treatment installation, until the loading zone made up of the fixed platform and the unfurled section of flexible sheet is full of containers.

The loaded containers are subsequently placed in the enclosure of the installation by the joint action of the cylinder and bar and of the flexible sheet. Said cylinder and bar push the containers deposited on the fixed platform as far as the flexible sheet, at the same time as said sheet moves to place itself entirely on a flat shelf of the treatment installation. Next, once all the containers are on the flexible sheet and the latter is on the flat shelf, said sheet retracts, sliding under the containers, while the bar and the cylinder keep the containers fixed and aligned on the flat shelf.

The unloading process is carried out by the flexible sheet itself. Firstly, said sheet is placed on the flat shelf, sliding under the containers, while the cylinder and the bar remain at the front part of the flat shelf acting as a stop. Secondly, said sheet retracts, thereby pushing the containers deposited on it towards the fixed platform and the conveyor belt which unloads them.

The working cycle of the device described also has the advantage of having no times lag, as upon completion of loading of each flat shelf, and while the vertical travel of the loaded shelf is taking place, containers can be loaded onto the fixed platform of the device.

The device described in utility model DE 20102879 U1 nevertheless has several disadvantages, as outlined below.

The working speed is limited, because during the loading process both the travel of the containers on the fixed platform and the travel of the flexible sheet itself with the loaded containers is carried out without the presence of a bar to act as a stop for said containers.

Indeed, it has to be taken into account that the intermittent advance of the flexible sheet is a source of continual movements of the containers deposited thereupon, which means that the working speed has to be reduced in order to prevent such containers from spilling or falling.

The unloading process has the disadvantage of not being completely automatic, since at the end of the unloading process it requires the assistance of an operative to push the last rows of containers left on the fixed platform towards the conveyor belt.

As has been described, the unloading process is carried out by the flexible sheet itself when, as it retracts, it pushes the containers deposited on it towards the fixed platform and the conveyor belt that unloads them. When the flexible sheet is left free of containers, however, and even if it does retract, it cannot push the last rows of containers to be unloaded, since those containers are deposited only on the fixed platform. Therefore, an operative must push said last rows of containers by means of a bar or the like so that they can be unloaded by the conveyor belt.

Another disadvantage of the device described in the German Utility Model is that it is an equipment that cannot be disassembled easily in order to submit its parts to cleaning and sterilisation each time the treatment installation is loaded.

Indeed, in order to carry out cleaning and sterilisation of the flexible sheet which winds and unwinds around the cylindrical drum, said sheet has to be unfurled completely, which involves a number of disadvantages. For instance, there is the need to have space to spread out the sheet, which can be large; such space can be difficult to achieve in the light of the space-restriction that exists in clean rooms.

DESCRIPTION OF THE INVENTION

The objective of this invention is to resolve the disadvantages mentioned by developing a device for loading and unloading containers into and out of an enclosure of an installation for treating the substances contained in said containers, which has the advantages described below.

In accordance with this objective, the device of this invention includes a support structure, means for positioning said containers on the device, a fixed platform, first means for moving said containers during a loading process, second means for moving the containers during a unloading process and third means for moving said second means to a position higher than said containers and for moving outside the enclosure of the treatment installation said second means, said second means acting as a stop during loading and as a pusher during unloading, and is characterised in that said device includes an extendible platform, said extendible platform unfurling from said support structure to form, during loading and unloading, a union between said fixed platform and an interior shelf of said enclosure, and in that said third means comprise parts that unwind from said support structure to the interior of the enclosure.

Thanks to these characteristics, the device of this invention has the following advantages:

- The loading and unloading system is completely automatic, so that an operative does not have to be present.
- The working speed is not limited, because during the loading process, the movement of the containers is carried out with the presence of said second means that act as a stop for said containers, in order to ensure that they advance aligned and to prevent them from spilling.
- The device occupies limited space in clean rooms, is easy to implement on an isolator and can be easily disassembled to submit its parts to cleaning and sterilisation.
- It is a device completely external to the treatment installation and so can be implemented in any existing treatment installation without the need for great structural modifications of that installation. Moreover, the device can be used in treatment installations of different models and even from different manufacturers.
- No part of the device remains inside the installation enclosure during the treatment process, so that cleaning and sterilisation of the freeze-dryer is not hindered nor the user obliged to handle auxiliary parts such as shelves or frames.

Preferably, said second means include a bar or the like mounted transversally to the direction of travel of the containers, and a pair of carriages which can move longitudinally, attached to both ends of said bar or the like.

Thanks to these characteristics, said bar or the like acts as a stop during loading and as a pusher during unloading, travelling due to the action of said carriages.

Preferably, said third means include at least two of said parts which drive each of said carriages, a rotary arm mounted between each one of said carriages and the aforesaid bar or the like and at least two other of said parts which drive each of said arms, so that said bar or the like moves to the position higher than the containers when said two second parts are pushed in the direction of said carriages.

Also preferably, said parts which drive said carriages each include at least one band or the like attached by one end to the carriage and by the other end to said device's support structure, and said parts which drive each of said arms includes at least one band or the like attached by one end to said device's support structure, a lever articulated by one end to said carriage and by the other end to said at least one band or the like, and an attaching piece between said at least one band or the like and said lever.

Thanks to these characteristics, a mechanism that allows the bar attached to the carriages to be raised above the containers is achieved. Said bar can thus be retracted from the interior shelf of the treatment installation once loading has been completed, or travel to the back of the interior shelf at the start of unloading. This mechanism has the advantages of being simple, taking up no space and being easy to disassemble.

Advantageously, said bands or the like are curved in the shape of a semicircular sector, so that a strip of material is obtained that is mechanically resistant to tension and compression. Moreover, this arrangement has a certain cantilevered flexural strength and permits winding onto a reel.

Also advantageously, said bar or the like includes a pair of wheels which facilitate its movement on said platforms and said interior shelf of the aforesaid enclosure.

Preferably, said means for positioning the containers include a horizontal conveyor belt, means for indexing the containers, and fixed guides for confining the containers during the loading and unloading processes. Thanks to these characteristics, the installation has different modules adapted for loading and unloading the containers.

Preferably, said first means for moving the containers during the loading process include at least one telescopic linear actuator which is integral to its free end to a bar or the like, with said bar acting as a pusher during loading and as a stop during unloading.

Also preferably, said treatment installation includes a pair of guides mounted parallel to said interior shelf and aligned with another pair of guides arranged longitudinally on said fixed platform and said extendible platform, along which said carriages move.

BRIEF DESCRIPTION OF THE DRAWINGS

For a better understanding of all that has been outlined some drawings are attached which show, schematically and solely by way of non-restrictive example, a practical case of embodiment.

In said drawings,

FIGS. 8*a*, 8*b* to 11*a* and 11*b* are plan and elevation views of the device of the invention showing different stages of the process of unloading containers from an enclosure of an installation for treating substances.

DESCRIPTION OF A PREFERRED EMBODIMENT

Figures 1A, 1B:
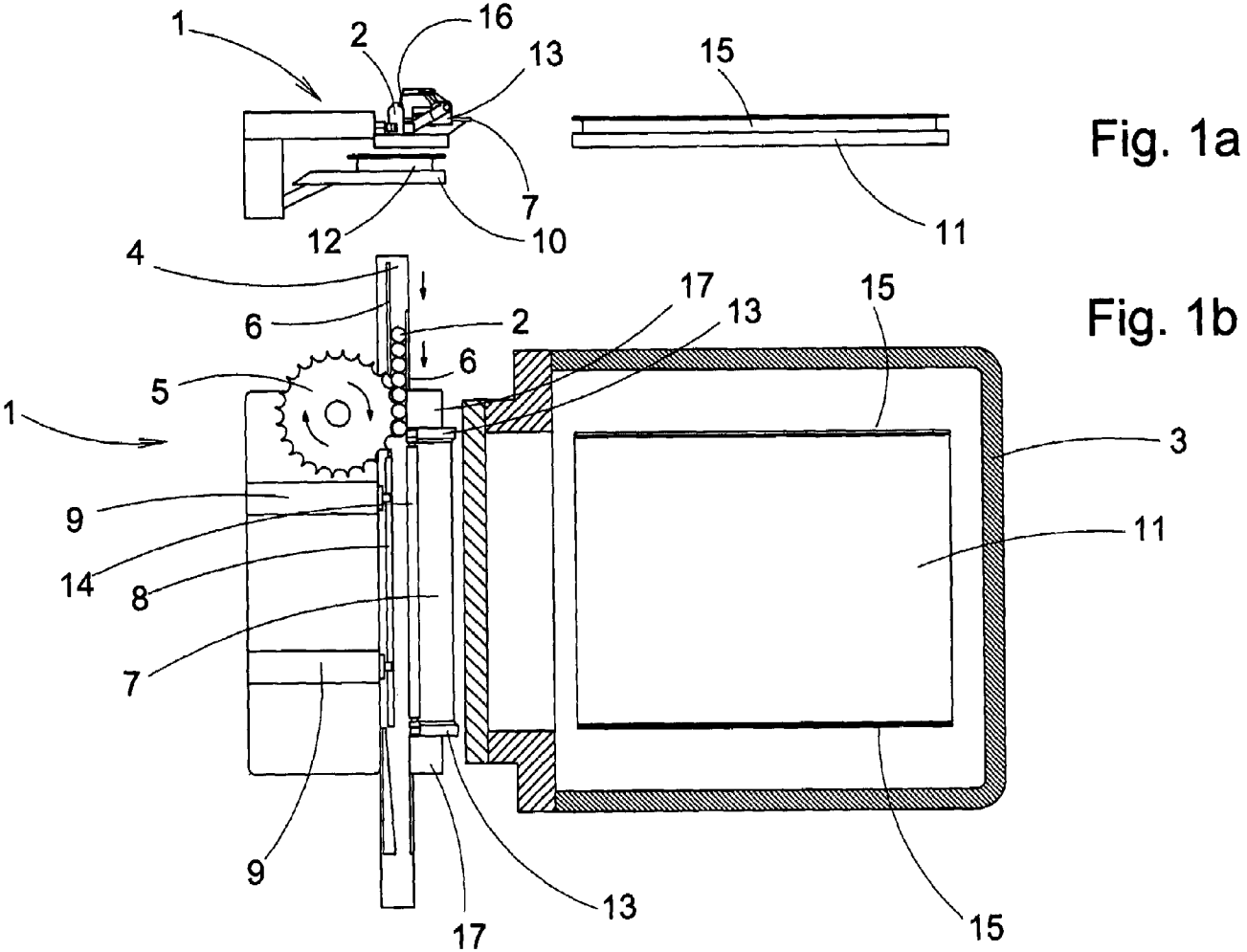
FIGS. 1*a* and 1*b* are plan and elevation views of the device of the invention, situated facing an installation for treating substances in containers.

FIGS. 1*a* and 1*b* show plan and elevation views of a device 1 for loading and unloading containers 2 into an enclosure of a treatment installation 3, which includes a conveyor belt 4 on which the containers 2 are distributed from a worm gear or indexing wheel 5, fed from a row of containers 2 confined between two fixed guides 6. The containers 2 distributed on the conveyor belt 4 are transferred to a fixed platform 7 by means of a pusher bar 8 mounted transversally to the direction of movement of the containers 2. Said pusher bar 8 is driven by two telescopic linear actuators 9.

Figure 2A:
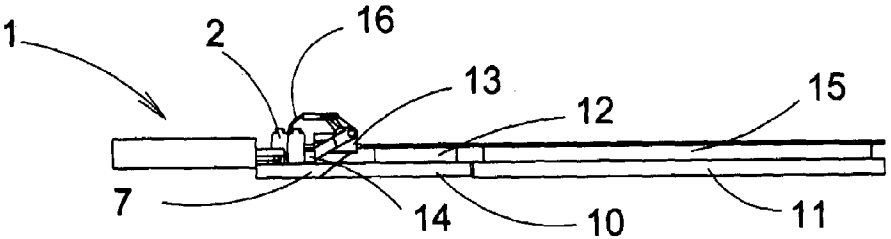
FIGS. 2*a* and 2*b* show plan and elevation views of the device of the invention, with the extendible platform unfurled into the interior of the treatment installation and with a first row of containers placed on the fixed platform
Figure 2B:
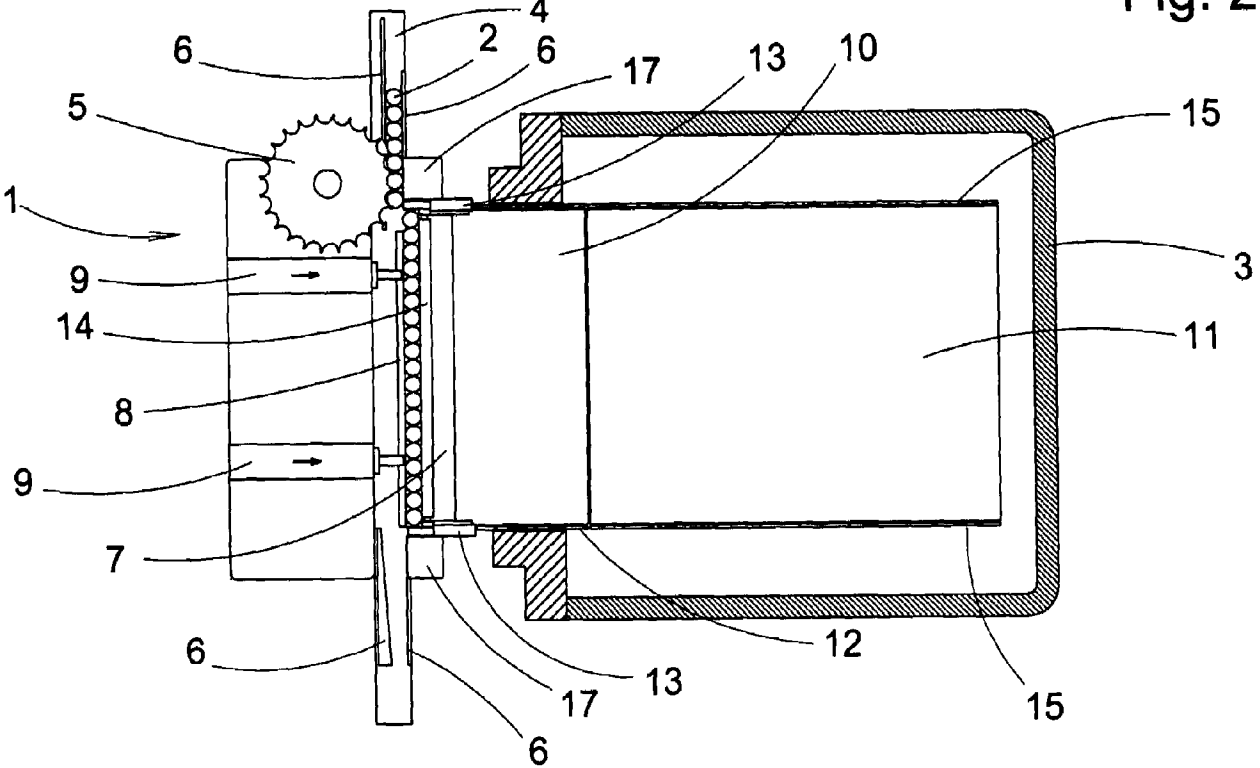

As the same FIGS. 1*a* and 1*b* show, the device 1 includes an extendible platform 10 which unfurls to attach the fixed platform 7 to an interior shelf 11 of the enclosure of a treatment installation 3, forming a horizontal, flat and smooth surface on which the containers 2 will move. FIGS. 2*a* and 2*b* show plan and elevation views of the device with said extendible platform unfurled.

The fixed 7 and extendible 10 platforms have a pair of guides 12 arranged longitudinally on their smaller sides, on which a pair of extendible carriages 13 move with a bar 14 attached by each one of its ends to one of said carriages 13. Said bar 14 acts as a stop during loading, keeping the containers 2 aligned during their movement, and as a pusher during unloading.

In the enclosure of the treatment installation 3 another pair of guides 15 is mounted parallel to said interior shelf 11 and aligned with the guides 12 of the fixed 7 and extendible 10 platforms, along which said extendible carriages 13 also move, when the latter unfurl in the interior of the treatment installation 3, driven by the bands 16 which can be coiled. Said bands 16 are wound onto and unwind from a pair of reels (not shown) provided on the support structure 17 of the device 1.

As noted in the description of the invention, the device 1 has the advantage of including a mechanism which permits the bar 14 attached to the extendible carriages 13 to be raised above the containers 2. The bar 14 can thus be retracted from the interior shelf 11 of the treatment installation 3 once loading has been completed, or travel to the back of the interior shelf 11 at the start of unloading.

Figure 3:
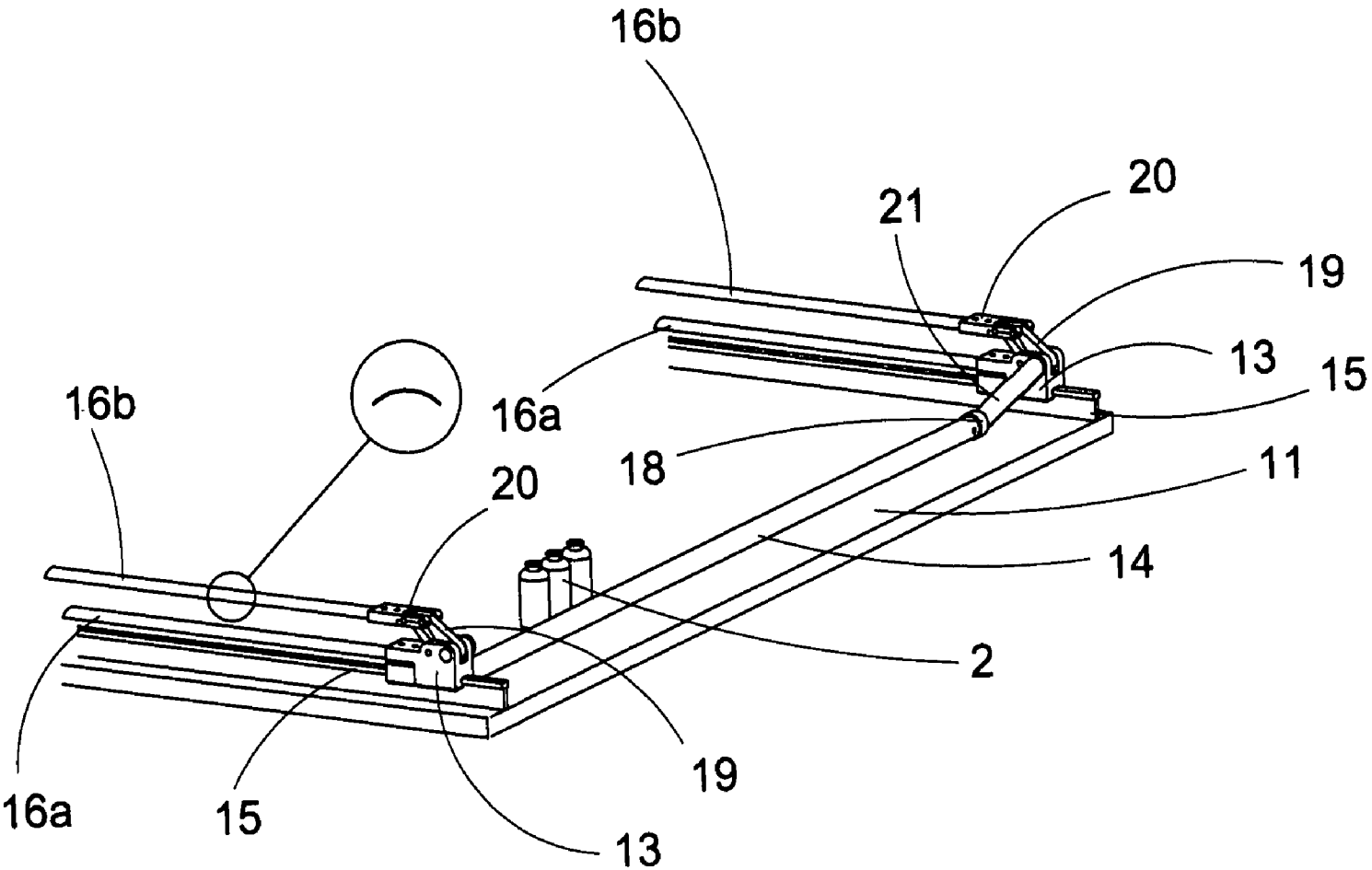
FIG. 3 is a perspective view showing a detail of the extendible carriages and curved bands of the device and of the bar, attached to said carriages, situated in their lowered position.
Figure 4:
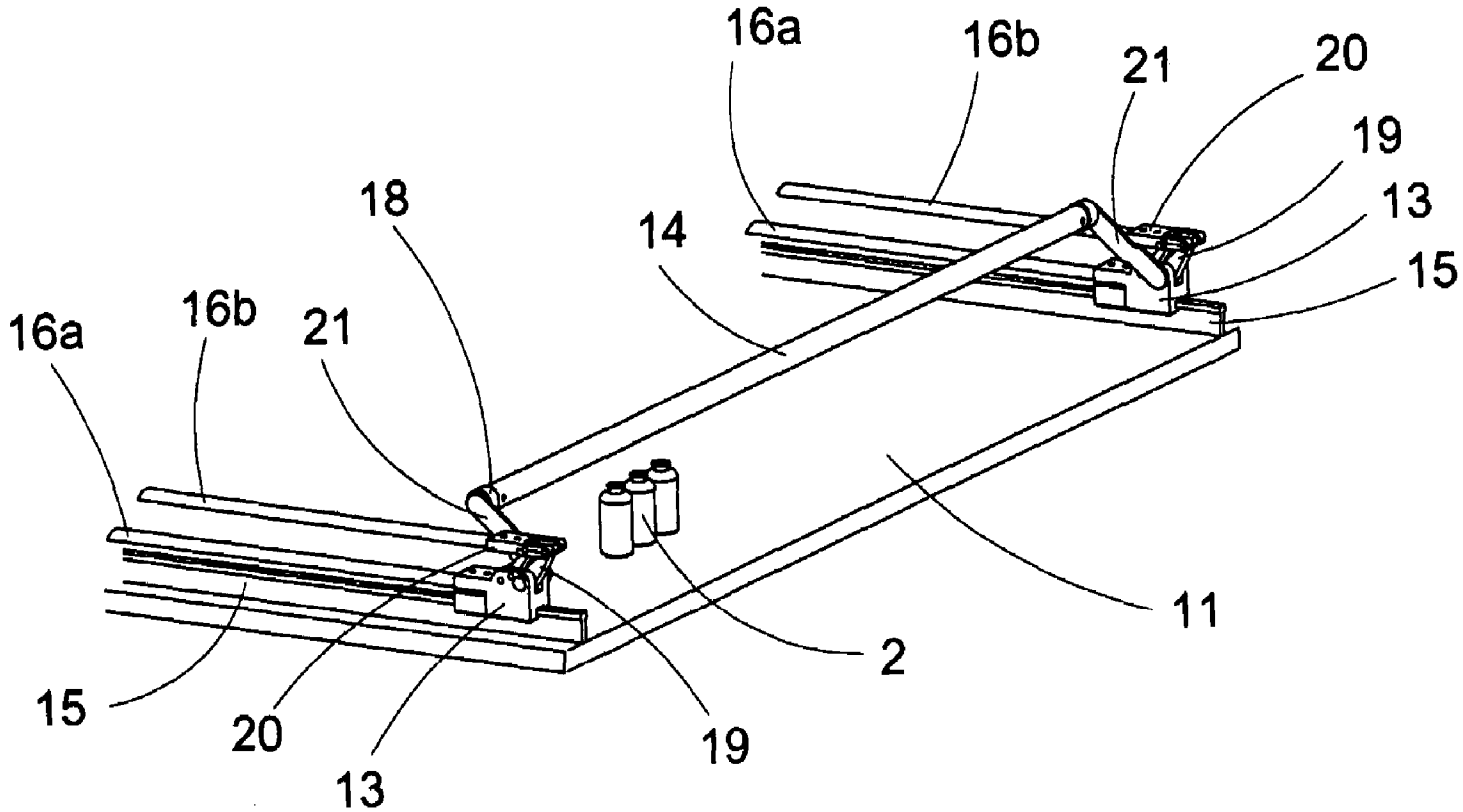
FIG. 4 is a perspective view showing a detail of the extendible carriages and curved bands of the device and of the bar, attached to said carriages, situated in their raised position.
Figure 5A:
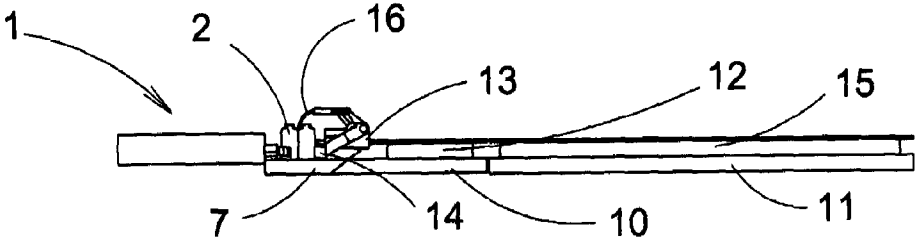
FIGS. 5*a*, 5*b*, 6*a*, 6*b* and 7*a*, 7*b* are plan and elevation views of the device of the invention showing different stages of the process of loading containers into an enclosure of an installation for treating substances.
Figure 5B:
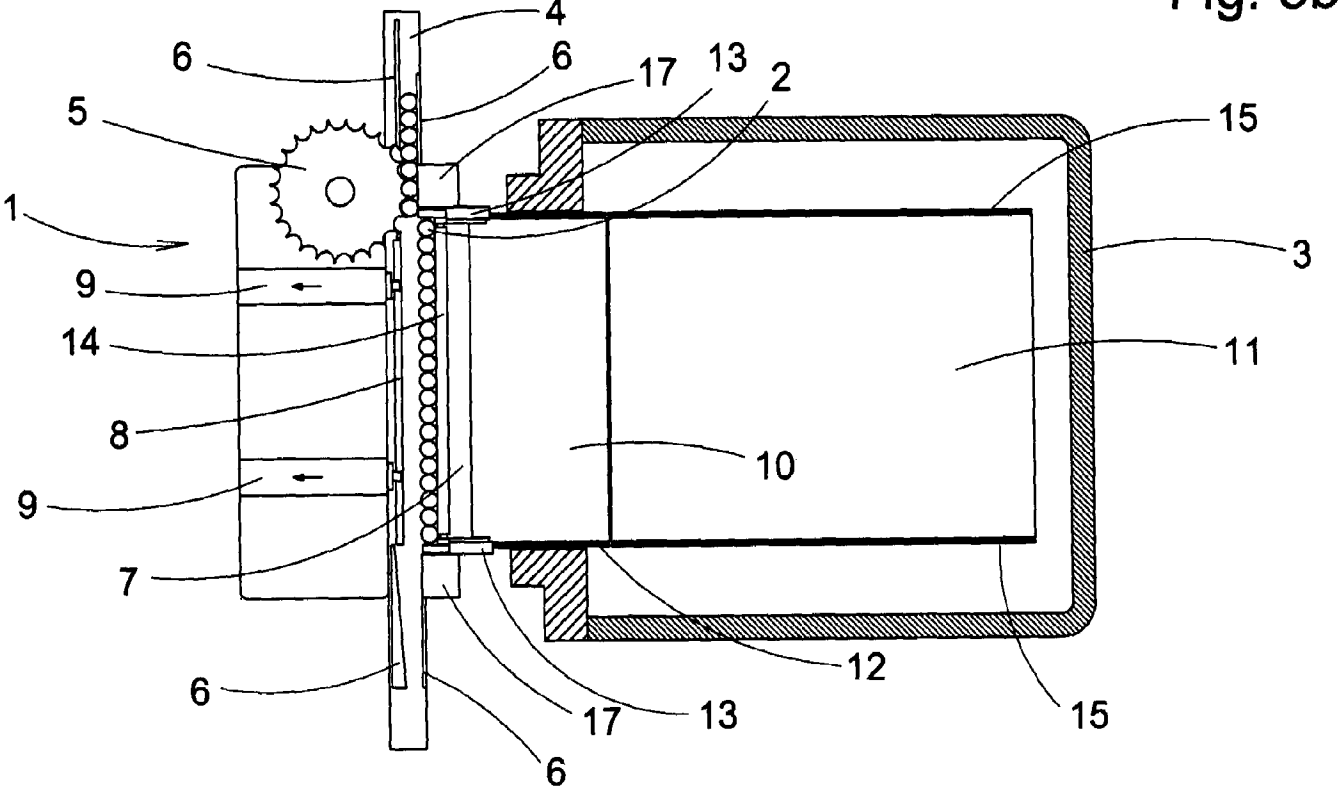

FIGS. 3 and 4 show a detail of the extendible carriages 13 with the bar 14 in two different working positions. In FIG. 3, the bar 14 is in its lowered position, with the wheels 18 touching the working surface, while in FIG. 4 the bar 14 is in its raised position, with the wheels 18 touching the shelf immediately above the interior shelf 11 on which the containers 2 are situated.

The mechanism which enables raising of the bar 14 includes a pair of parallel curved bands 16, in the shape of a semicircular sector, for each one of the carriages 13. The lower bands 16*a* are attached by one end to the corresponding extendible carriage 13, and by the other end to a spool of the corresponding reel (not shown) onto which they wind. The upper bands 16*b* are attached by one end to a lever 19 of the corresponding extendible carriage 13, by means of an attaching piece 20, and by the other end, to another spool of the corresponding reel (not shown).

The lever 19 of each of the carriages 13 is articulated by one end to the corresponding carriage 13, and by the other end to the attaching piece 20 of the corresponding upper band 16*b*.

The mechanism that enables raising of the bar 14 further includes a rotary arm 21 for each extendible carriage 13 that is attached by one end to the bar 14 and by the other end to said lever 19 of the extendible carriage 13.

In order to raise the bar 14, the upper bands 16*b* work under compression, pushing the attaching piece 20, while the lower bands 16*a* keep the corresponding extendible carriages 13 fixed. The thrust on the attaching pieces 20 by the upper bands 16*b* makes each of the levers 19 rotate on a shaft which is integral to the rotary arm 21 of the corresponding extendible carriage 13, so that said rotary arms 21 rise and drag the bar 14 upwards.

In order to lower the bar 14, the upper bands 16*b* work under tension, pulling on the attaching piece 20, while the lower bands 16*a* keep the corresponding extendible carriages 13 fixed. The actuation of the attaching pieces 20 by the upper bands 16*b* makes said levers 19 and said rotary arms 21 rotate simultaneously, so that the bar 14 lowers.

Although it has not been described, the raising and lowering of the bar 14 can be carried out while the extendible carriages 13 are moving, by means of synchronised movement of the upper bands 16*b* and the lower bands 16*a*.

There follows a description of the operation of the device of the invention for loading and unloading containers.

FIGS. 1*a*, 1*b*, 2*a*, 2*b* and 5*a*, 5*b* to 7*a*, 7*b* show plan and elevation views of different stages of the loading process of containers 2 in an enclosure of a treatment installation 3.

The loading process starts by distribution of a row of containers 2 on the conveyor belt 4 of the device 1, from the indexing wheel 5. The containers 2 placed on the conveyor belt 4 are moved a distance equal to their diameter to the fixed platform 7, by means of the pusher bar 8, driven by the linear actuators 9. Once the containers 2 have been moved to the fixed platform 7, the pusher bar 8 retracts to its initial position, so that the conveyor belt 4 is once again free for loading a new row of containers 2. This operation is repeated until all the rows of containers 2 to be placed on the interior shelf 11 have been accumulated on the loading surface.

Figure 6A:
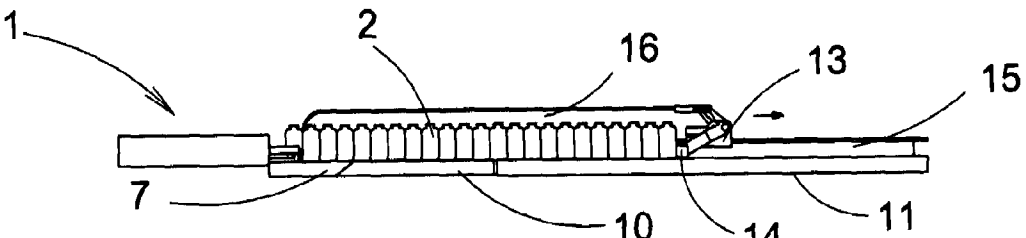
Figure 6B:
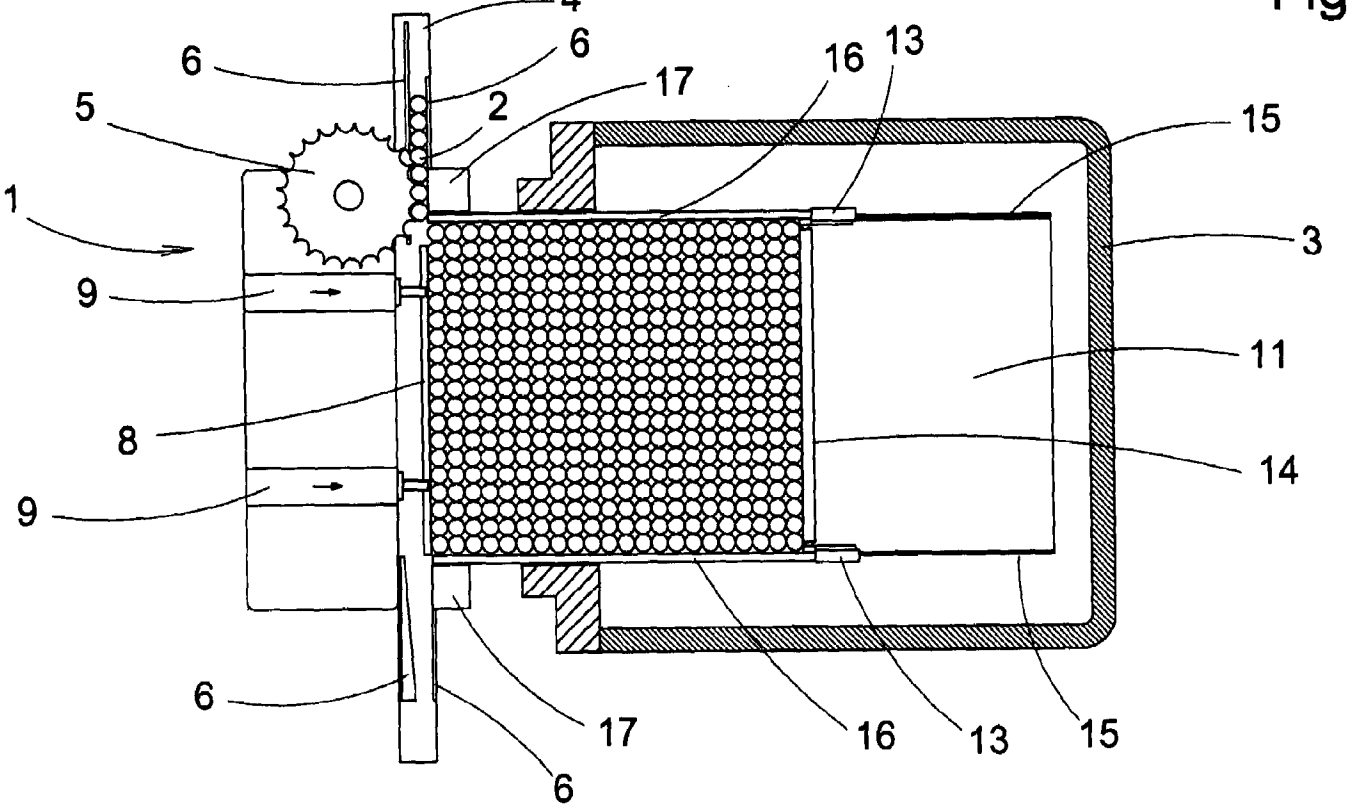
Figure 7A:
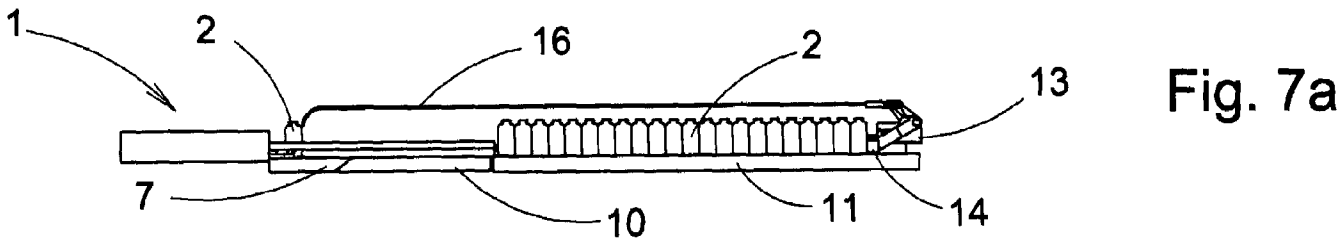
Figure 7B:
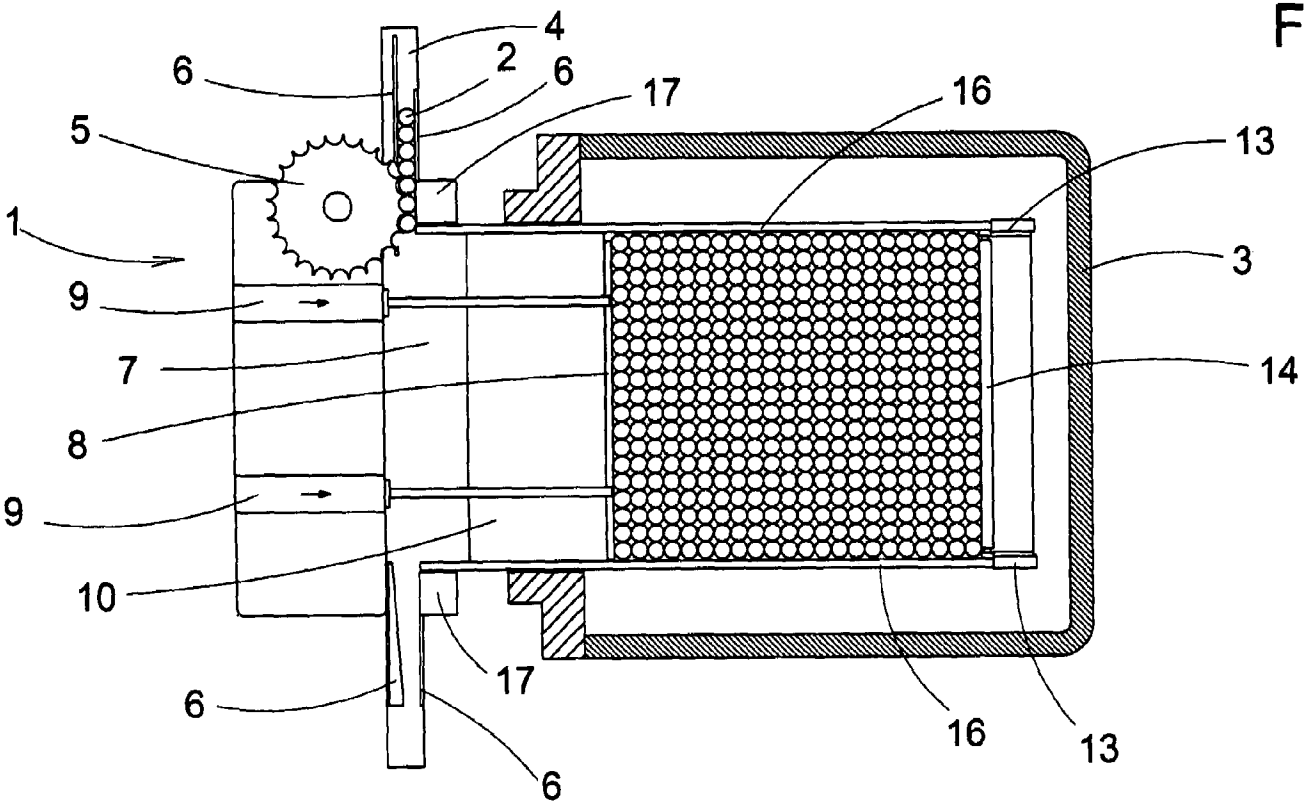

As FIGS. 6*a* and 6*b* show, the loading surface is made up of the fixed platform 7, the extendible platform 10 and part of the interior shelf 11 of the treatment installation 3. This surface is delimited laterally by the guides 15, which confine the containers 2, to the front by the pusher bar 8 and to the rear by the bar 14 attached to the extendible carriages 13. Said bar 14 acts as a stop throughout the entire loading process, keeping the containers 2 aligned and preventing them from spilling.

Once the loading of containers 2 onto the aforesaid surface has been completed, there takes place the movement at once of said containers to the interior shelf 11 under the action of the pusher bar 8 which moves in synchronisation with the bar 14 of the extendible carriages 13.

Next, the bar 14 of the carriages 13 rises, thanks to the mechanism described above, and moves back from the interior shelf 11, moving above the containers 2 and retracting to its initial position with the pusher bar 8. Once the extendible carriages 13 are in their initial position again the bar 14 lowers, the extendible platform 10 retracts partially and the conveyor belt 4 begins to load more containers 2. In the treatment installation 3, meanwhile, there takes place the vertical movement of the interior shelves 11 in order to place, in front of the device 1, the next empty shelf 11, ready for loading it.

Figure 8A:
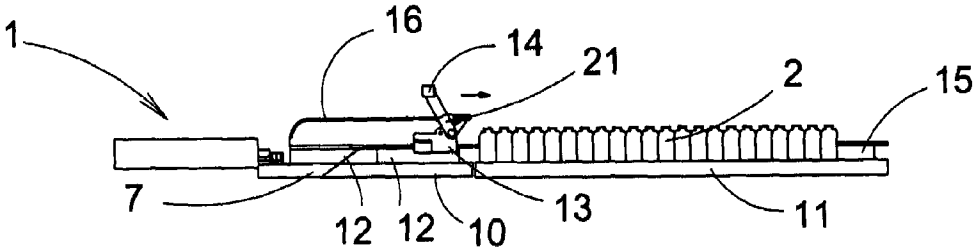
Figure 8B:
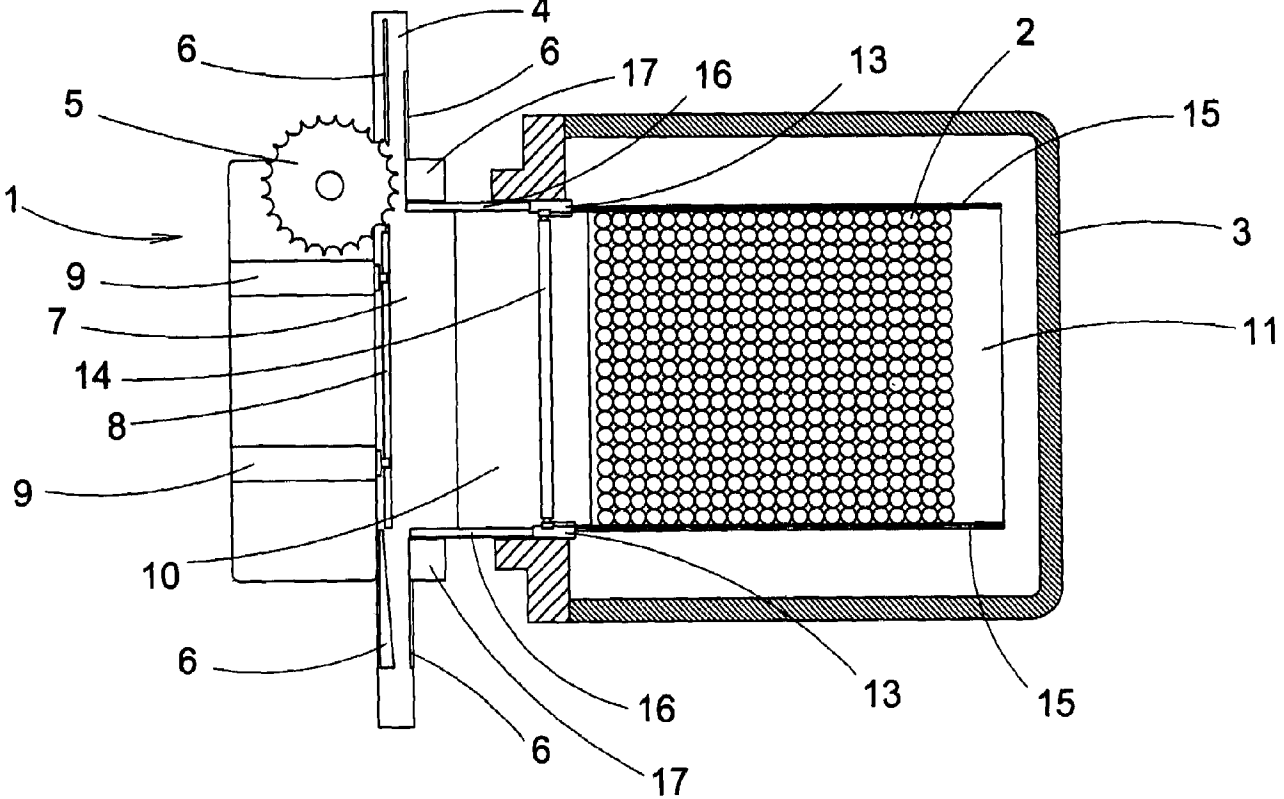
Figure 9A:
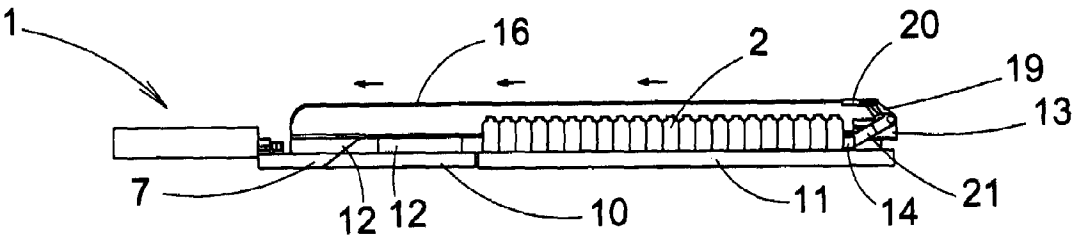
Figure 9B:
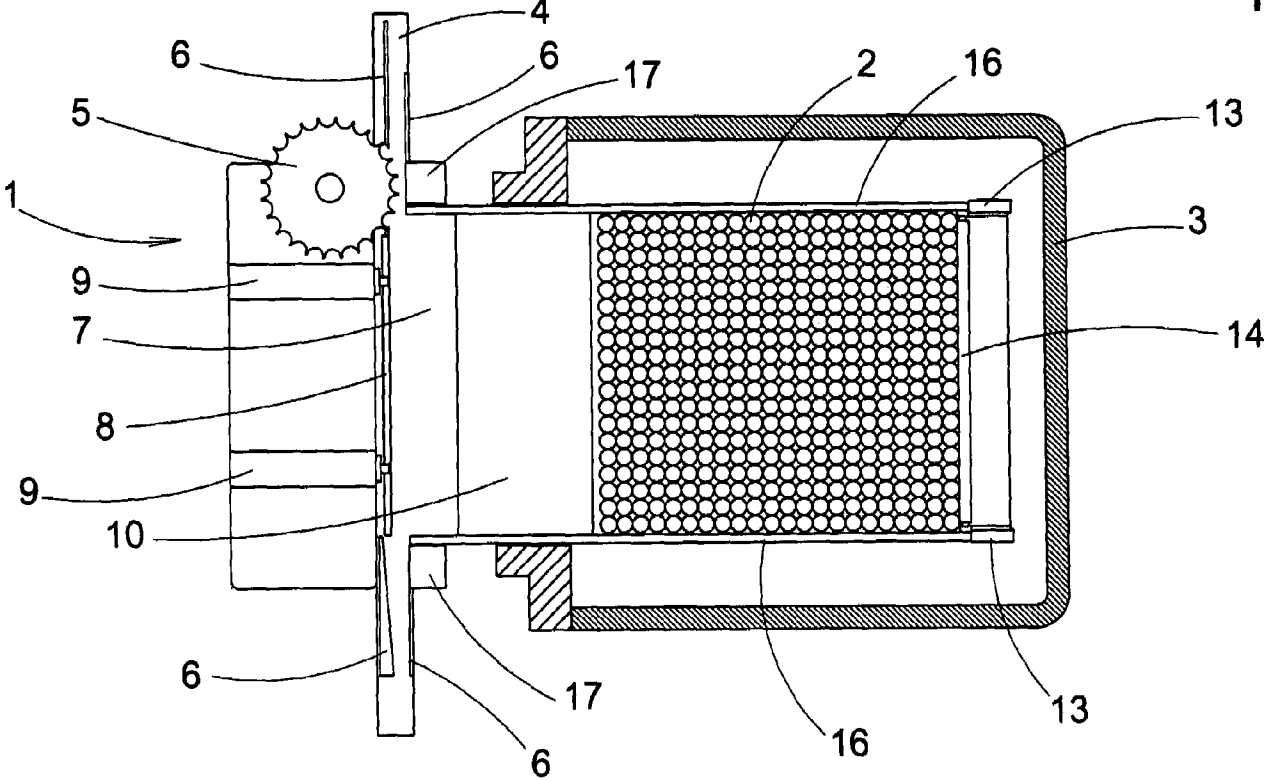

FIGS. 8*a*, 8*b* a 11*a*, 11*b*, show plan and elevation views of different stages of the unloading process of containers 2 in an enclosure of a treatment installation 3.

The unloading process begins when the extendible platform 10 of the device unfurls up to the interior shelf 11 of the treatment installation 3, situated facing the device 1. Next, the carriages 13 travel to the back of the interior shelf 11 with the bar 14 raised, and the pusher bar 8 extends completely, driven by the linear actuators 9, until it touches the first row of containers 2 on the shelf 11. During the movement of the extendible carriages 13 the wheels of the bar 14 are in contact with the shelf 11 immediately above.

Once the extendible carriages 13 have been situated on the rear part of the shelf 11, the bar 14 descends due to the mechanism described above, and is left situated behind the last row of containers 2. Next, the extendible carriages 13 retract towards the outside of the treatment installation 3, in synchronisation with the bar 8, so that the bar 14 pushes the containers 2 at once towards the conveyor belt 4, while the bar 8 now acts as a stop. The containers 2 are thus situated on the surface made up of the fixed platform 7, the extendible platform 10 and part of the interior shelf 11.

Figure 10A:
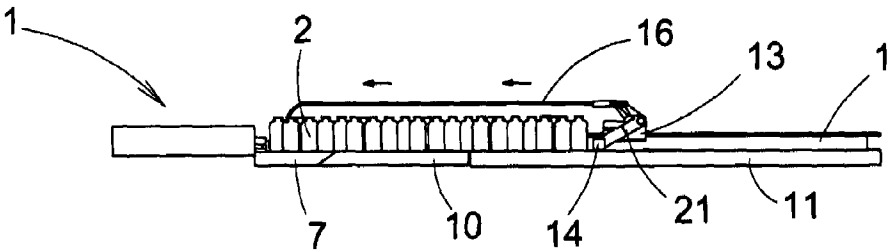
Figure 10B:
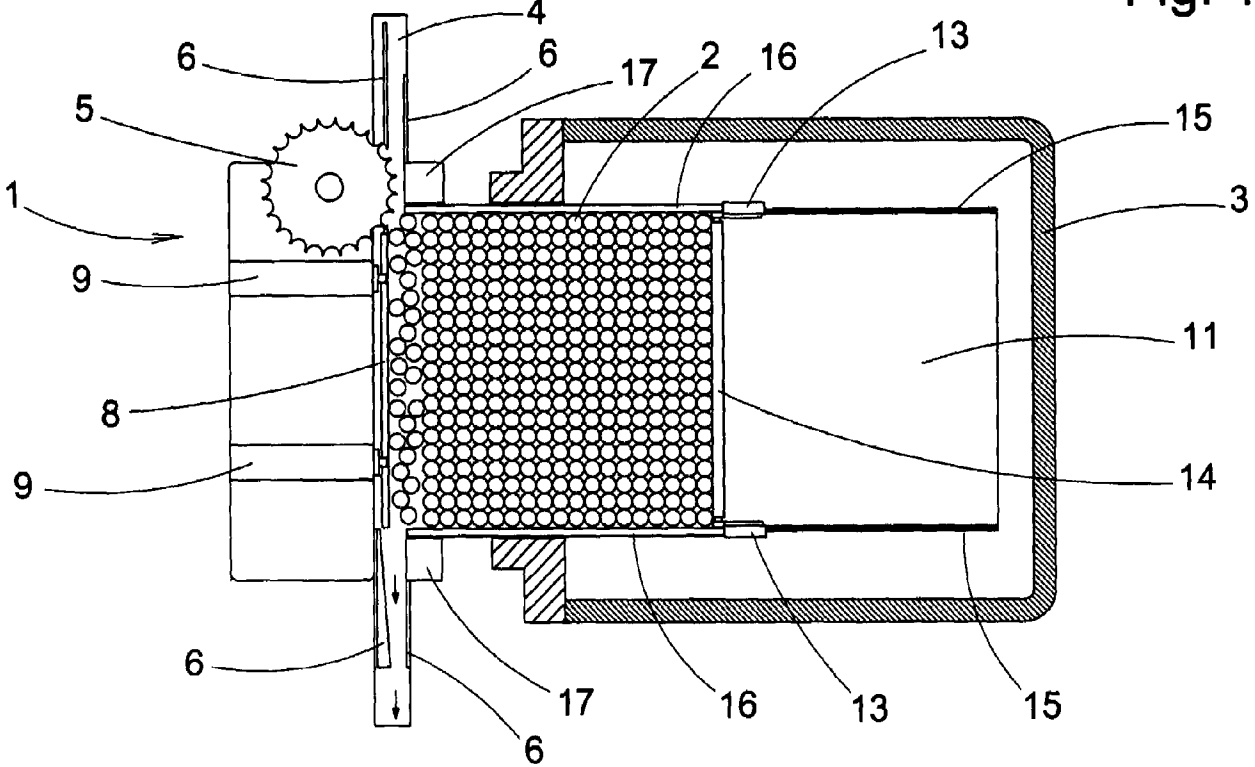
Figure 11A:
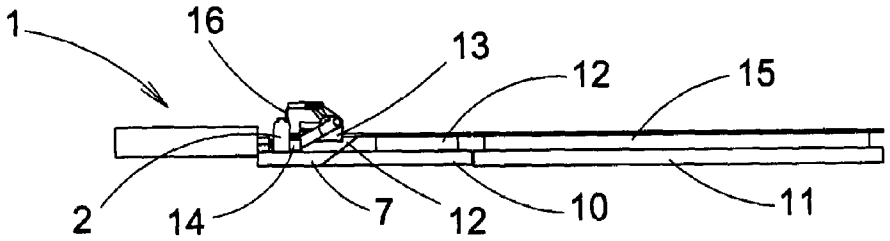
Figure 11B:
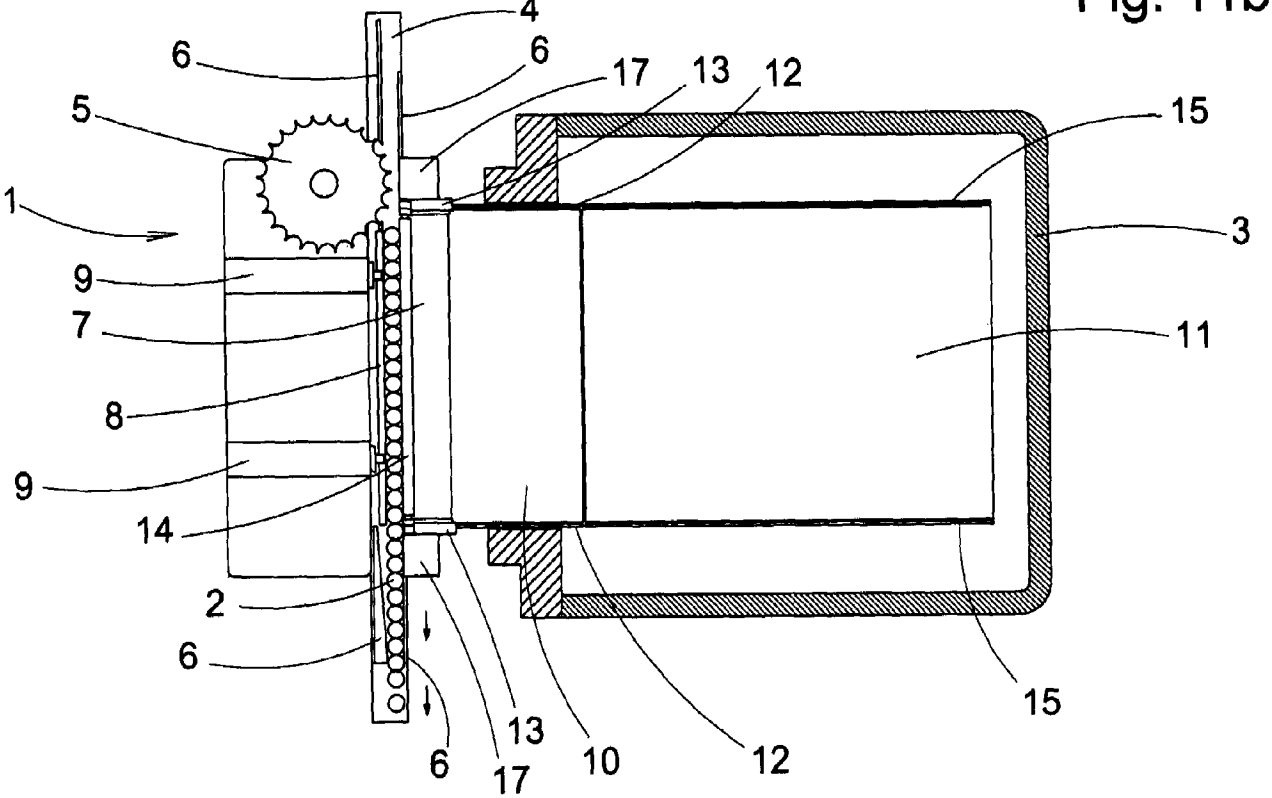

As FIGS. 10*a* and 10*b* show, the unloading of the containers 2 by the conveyor belt 4 takes place as the bar 14 of the extendible carriages 13 pushes the containers 2 towards the outside of the interior shelf 11 and then forces them to emerge along said conveyor belt 4. When no more containers 2 are left on the extendible platform 10, the latter moves back partially in order to allow the next interior shelf 11 to lower in order to be later unloaded. Meanwhile, the containers 2 which are left on the fixed platform 7 continue to be pushed towards the conveyor belt 4 by the bar 14 of the carriages 13.

Surprisingly, this invention achieves a device 1 for loading and unloading containers (2) which, in addition to being fast, taking up a very limited space and being easy to disassemble, is completely automatic, since it does not require the presence of an operative.

The invention claimed is:

1. A device for loading and unloading containers into and out of an enclosure of an installation for treating substances contained in said containers, the device including:

a support structure, means for positioning said containers on the device, a fixed platform, first means for moving said containers during a loading process, second means for moving the containers during an unloading process, and third means for moving said second means to a position higher than said containers when moving said second means into and out of said enclosure of the treatment installation, wherein said second means act as a stop during loading and as a pusher during unloading, wherein said device includes an extendible platform, said extendible platform unfurling from said support structure to form, during loading and unloading, a union between said fixed platform and an interior shelf of said enclosure, and wherein said third means comprises a first part and a second part that unwind from said support structure to the interior of the enclosure.

2. The device for loading and unloading containers according to claim 1, wherein said second means include a bar mounted transversally to the direction of travel of the containers, and a pair of carriages which can move longitudinally, attached to both ends of said bar.

3. The device for loading and unloading containers according to claim 2, wherein said third means include at least two of said first parts which drive said carriages, a rotary arm mounted between each of said carriages and the bar and at least two other of said second parts which drive each of said arms, so that said bar moves to the position higher than the containers when said two second parts are pushed in the direction of said carriages.

4. The device for loading and unloading containers according to claim 3, wherein said first parts which drive said carriages each include at least one band attached by one end to carriage and by the other end to the support structure of said device.

5. The device for loading and unloading containers according to claim 3, wherein each of said second parts which drive each of said arms includes at least one band attached by one end to the support structure of said device, a lever articulated by one end to said carriage and by the other end to said at least one band, and an attaching piece between said at least one band and said lever.

6. The device for loading and unloading containers according to claim 4, wherein said bands are curved in the shape of a semicircular sector.

7. The device for loading and unloading containers according to claim 2, wherein said bar includes a pair of wheels which facilitate its movement on said platforms and said interior shelf of the enclosure.

8. The device for loading and unloading containers according to claim 1, wherein said means for positioning the containers include a horizontal conveyor belt, means for indexing said containers, and fixed guides for confining the containers during the loading and unloading process.

9. The device for loading and unloading containers according to claim 1, wherein said first means for moving the containers during the loading process include at least one telescopic linear actuator which is integral to its free end to a bar, with said bar acting as a pusher during loading and as a stop during unloading.

10. The device for loading and unloading containers according to claim 5, wherein said bands are curved in the shape of a semicircular sector.

11. The device for loading and unloading containers according to claim 1, wherein said support structure is external of said enclosure.

12. The device for loading and unloading containers according to claim 1, wherein all components are positioned outside said enclosure during a treatment process.

13. A device for loading and unloading containers into and out of an enclosure of an installation for treating substances contained in said containers, the device including:

a support structure;

means for positioning said containers on the device;

a fixed platform;

first means for moving said containers during a loading process;

second means for moving the containers during an unloading process; and third means for moving said second means to a position higher than said containers when moving said second means into and out of said enclosure of the treatment installation, wherein said second means act as a stop during loading and as a pusher during unloading, wherein said device includes an extendible platform, said extendible platform unfurling from said support structure to form, during loading and unloading, a union between said fixed platform and an interior shelf of said enclosure, and wherein said third means comprises upper and lower parts that unwind from said support structure to the interior of the enclosure, the upper part working under compression and tension when raising and lowering the second means, respectively.

* * * * *